United States Patent [19]

Nash et al.

[11] 3,956,958

[45] May 18, 1976

[54] DEVICE FOR PRODUCING A SIGNAL IN RESPONSE TO A MOVEMENT THEREON

[76] Inventors: Daniel T. Nash, 35 Colony Road, New Haven, Conn.; Frank A. Savage, 11 Shady Hill Square, Cambridge, Mass. 02138

[22] Filed: July 15, 1975

[21] Appl. No.: 596,079

Related U.S. Application Data

[63] Continuation-in-part of Ser. No. 495,683, Aug. 8, 1974, abandoned.

[52] U.S. Cl. ..... 84/1.01; 84/DIG. 7

[51] Int. Cl.[2] ..... G10H 1/00

[58] Field of Search ..... 85/1.01, 1.17, 1.24, 85/1.27, DIG. 7; 200/86.5; 128/25; 119/29

[56] References Cited

UNITED STATES PATENTS

| | | | |
|---|---|---|---|
| 3,439,568 | 4/1969 | Griffith | 84/1.01 |
| 3,749,810 | 7/1973 | Dow | 84/1.24 |
| 3,754,495 | 8/1973 | Honegger | 84/DIG. 7 X |
| 3,775,546 | 11/1973 | Honegger | 84/1.01 |

*Primary Examiner*—Ulysses Weldon
*Attorney, Agent, or Firm*—Kirschstein, Kirschstein, Ottinger & Frank

[57] ABSTRACT

A multiplicity of pressure-sensitive switching devices are mounted beneath a surface and a selected number are connected by circuit means through a programmer to at least one signal generating apparatus. When a pressure-sensitive switching device is closed, the signal generating apparatus is activated and a particular signal is produced. As a series of pressure-sensitive switching devices are closed as an individual moves across the surface, the signals produced will be coordinated with that movement.

The programmer permits any pressure-sensitive switching device to be placed in circuit to generate any identified signal so that each pressure-sensitive switching device can be made to activate a particular signal. The programmer permits the signal generated when a particular pressure-sensitive switching device is closed to be changed.

In an alternative embodiment, electronic switching means in the circuit will automatically place the pressure-sensitive switching devices in a different circuit to vary the signal produced when one or all of the pressure-sensitive switching devices are closed. The electrical switching means may be responsive to movement on the surface of the device or may vary the signal to be produced after a predetermined time period.

3 Claims, 8 Drawing Figures

DEVICE FOR PRODUCING A SIGNAL IN RESPONSE TO A MOVEMENT THEREON

CROSS REFERENCE TO RELATED APPLICATION

This application is a continuation in part application of our co-pending application, Ser. No. 495,683 filed on Aug. 8, 1974 for A Device For Producing A Signal In Response To A Movement Thereon now abandoned.

BACKGROUND OF THE INVENTION

1. Field of the Invention.

The present invention relates to a signal generating device, and more particularly, to a device for producing a signal in response to movement across the surface.

2. Prior Art

It is well known in the art to place pressure-sensitive switches beneath the floor to produce signals when a section of floor is stepped on. For instance, U.S. Pat. No. 3,775,546 describes a ladder-like electronic musical instrument wherein contact switches are positioned beneath the rungs of the ladder-like structure. By pressing on the rungs the contact switches are closed causing a particular tone to be generated. This structure may be incorporated into a flooring so that movement on the floor will cause the tones to be generated.

In U.S. Pat. No. 3,749,810 there is disclosed a choreographic musical and/or luminescent appliance comprising a cage-like structure with switches positioned in the floor, which when closed will activate a particular musical sound or light effect.

While both of these patents disclose structures wherein movement on a surface will cause a particular sound to be generated, neither structure has associated therewith means to permit a rapid changing of signals to be produced when a particular switching element is closed.

It is toward elimination of these and other problems that the present invention is directed.

SUMMARY OF THE INVENTION

It is an object of the present invention to provide a device which will produce a signal that is coordinated with movement thereon.

Another object of the present invention is to provide a programmer to permit the signals to be produced when a particular switch on the device is closed to be quickly and easily varied.

Still another object of the present invention is to provide a electronic switching means to enable changes to be made automatically to the signal to be produced when a particular switching device is closed.

Generally, in accordance with the present invention, the foregoing and other objects are achieved by a device consisting of a multiplicity of pressure-sensitive switching devices mounted beneath a surface. The pressure-sensitive switching devices are connected in circuit through a programmer to at least one signal generating apparatus so that when a particular pressure-sensitive switching device is closed, the signal generating apparatus is activated and a particular signal is produced. In this manner, the signals produced are coordinated with movement across the surface.

The programmer within the circuit provides a means whereby the particular signal that will be generated when a particular pressure-sensitive switching device is closed may be changed. The programmer has a multiplicity of terminals leading to the particular signal generating apparatus corresponding to the various signals that can be produced. A particular pressure-sensitive switching device is connected to that terminal corresponding to the signal desired to be produced when that pressure-sensitive switching device is closed. In this manner, each pressure-sensitive switching device can be connected to a particular terminal so that closing the pressure-sensitive switching device will generate a particular sound.

In an alternative embodiment, electrical switching means within the circuit will automatically place the pressure-sensitive switching devices in a different circuit thereby varying the signals produced when one or all of the pressure-sensitive switching devices are activated. The electrical switching means may be responsive to movement on the surface of the device, or may vary the signal after a predetermined period of time has lapsed.

The present invention accordingly consists of and resides in the features of construction, combination of elements and arrangement of parts which will be exemplified in the device hereinafter described and of which the scope of application will be indicated in the appended claims.

BRIEF DESCRIPTION OF THE DRAWINGS

For a better understanding of the present invention, reference should be had to the accompanying drawings, wherein like numerals of reference indicate similar parts throughout the several views and wherein.

DESCRIPTION OF THE PREFERRED EMBODIMENT

Figure 1:
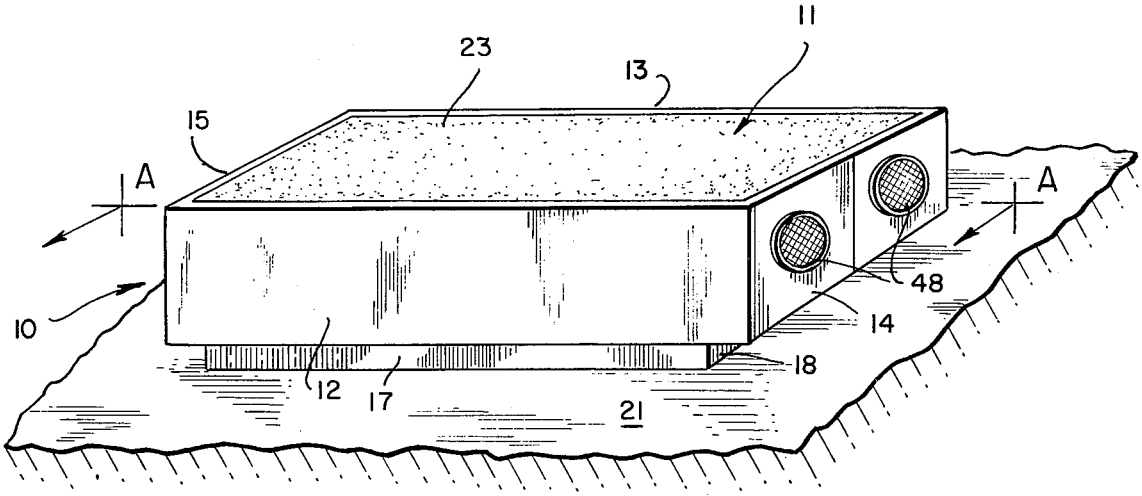
FIG. 1 is a perspective view of a device constructed in accordance with the present invention.

Referring now to the drawings there is shown in FIG. 1 a device constructed in accordance with the present invention designated generally by the reference numeral 10.

Figure 4:
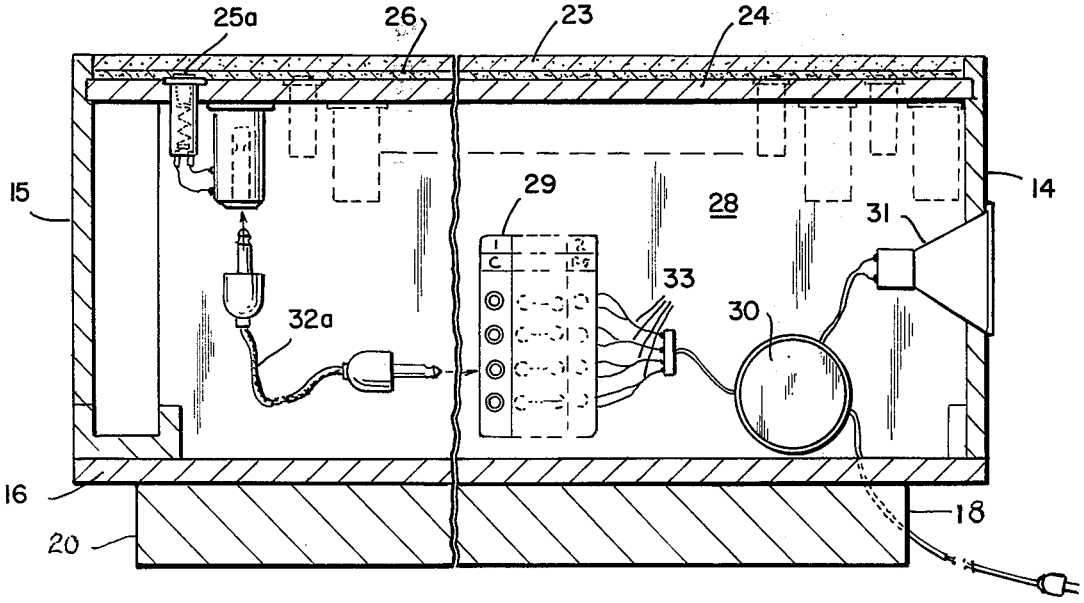
FIG. 4 is a sectional view taken along lines 4—4 in FIG. 1, wherein the signal generating circuitry is represented schedmatically.

As shown, the device comprises a platform 11 having a front panel 12, a rear panel 13 and two side panels 14 and 15. The platform 11 is shown as having a square perimeter, but it is to be understood that the platform could be triangular or circular or any other shape. The panels 12, 13, 14 and 15 are mounted to a base 16 as shown in FIG. 4.

As will be described hereinafter in detail, the present invention can be used to generate audio or visual signals, and the signal producing apparatus may be located within the platform or remote therefrom. When audio signals will be generated by a signal generating apparatus located within the platform having speakers located in the platform panels, a rise is provided which will aid in resonance of the sound produced. The rise is essentially walls 17, 18, 19, and 20 supporting the base 16 above the floor 21. Walls 19 and 20 are not shown. Access to the top of the platform 11 is provided by steps 22.

On the top of the platform 11 is a cover surface 23. The cover surface 23 can be of a flexible material so that pressure applied to the cover surface immediately above a pressure-sensitive switching device will close the pressure-sensitive switching device.

Figure 2:
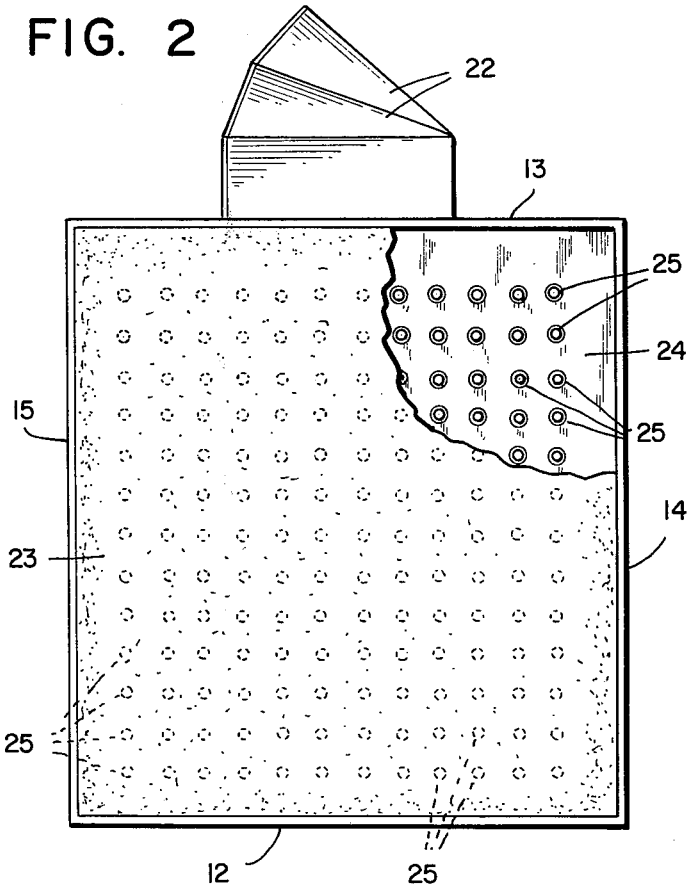
FIG. 2 is a top view of a device constructed in accordance with the present invention with a portion of the cover surface removed.

As shown in FIG. 2, beneath the cover surface 23 is a support surface 24 which supports the cover surface 23. Located in the support surface 24 are a multiplicity of pressure-sensitive switching devices 25. The pressure-sensitive switching devices or switches 25 can be mounted in a predetermined pattern in the support surface 24. They are shown being arranged in a square grid pattern, but it is to be understood that they may be mounted in any configuration which will conform to the overall shape of the platform 11. The switches are preferably of the spring bias type normally open, so that they may complete a circuit when they are depressed and may open the circuit when the pressure is removed.

While the device in accordance with the present invention can be used for any signal generation, either sound or light, the following discussion will concern itself with the generation of sound signals. It would be obvious to one skilled in the art to include the necessary signal generating apparatus to generate a light signal in addition to, or in substitution for, the sound signal generation.

As shown in FIG. 4, the necessary circuitry for the signal-generating system is located within a chamber 28 of the device 10. It is to be understood that the signal generating apparatus may be in a location remote from the platform 11. In that case, as an alternative mode of construction, the cover surface 23 along with the support surface 24 may be placed flush with the floor 21.

The signal-generating system is composed of a programmer 29, a sound-generating apparatus 30, and a speaker system 31. Each of the switches 25 are in circuit with a current source as will be hereinafter described in detail. A predetermined number of switches 25 are connected to the programmer 29 by means of conductors 32. As shown, switch 25*a* is connected by means of conductor 32*a*.

The programmer 29 is connected to the sound-generating apparatus 30 by a plurality of conductors 33 in a manner to be described hereinafter. The speakers 31 can be mounted in the panels of the platform 11 as shown or may be mounted in some remote location.

Figure 3:
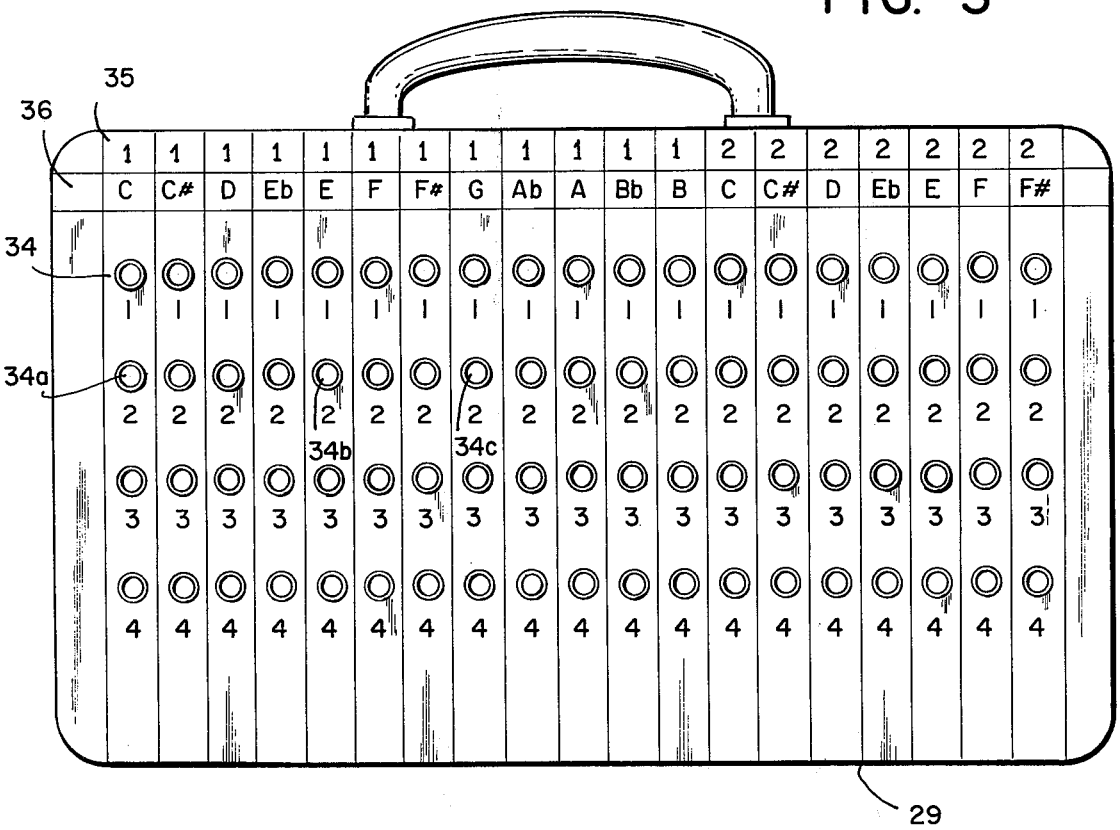
FIG. 3 is a front view of the programmer constructed in accordance with the present invention.

The general concept of the programmer 29 can be understood with reference to FIG. 3. A multiplicity of terminals or plug-in jacks 34, which are in circuit with the input contact 40 in the signal generating apparatus, are arranged in columns and rows in the programmer 29 to form sets. Each of the columns of terminals 34 is identified as to the characteristics of the sound signal which will be produced by the sound-generating apparatus if that terminal is used. The indicia in the first row 35 correspond to the octave of the note and the indicia in the second row 36 correspond to the identity of a particular note than can be produced by the sound-generating apparatus 30. The terminals 34 are connected by conductors 33 to the contacts of the sound-generating apparatus 30 which correspond to that particular note.

For example, if the switch 25*a* is connected to terminal 34*a*, when the switch 25*a* is depressed the note C in the first octave will be produced by the sound-generating apparatus. In addition, the switch 25*a* may be connected not only to terminal 34*a* but also to plug in terminals 34*b* and 34*c* and when closed a major C chord in the first octave will be produced. Thus it can e seen that by connecting a predetermined number of switches 25 to predetermined terminals 34 a series of notes or chords may be produced as the switches are closed.

Since each of the switches 25 can be programmed to either produce a particular note or no note al all, switches 25 may be closed in such an order that movement across the surface of the platform will cause notes to be generated in a particular sequence. For instance, an individual, by properly programming the switches 25 and by determining their location beneath the covering 23, while he performs a dance sequence on the surface 23, produce the accompanying music. In this manner, the sound generated will be coordinated with the individual's movement across the surface.

While the above discussion concerned production of notes or chords, it is to be understood that a series of notes or chords can be produced when the switch 25*a* is depressed, by providing a sound generating apparatus capable of such sound generation. It is also to be understood that while only a single sound generating apparatus is discussed, several different apparatus may be connected to the programmer 29 so that sounds may be produced from several different apparatus in the manner heretofore described.

Figure 5:
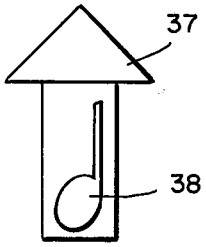
FIG. 5 is an indicator.
Figure 6:
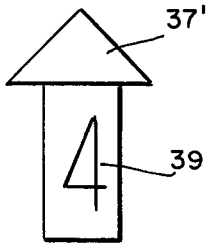
FIG. 6 is an indicator of an alternate form.

FIGS. 5 and 6 show alternate means for locating and identifying the switches 25. In FIG. 5, the indicator 37 has the general shape of an arrow bearing a musical symbol 38, indicating the period of time during which the switch 25 should be closed. The indicator 37 can be provided with an adhesive backing so that it may be fixedly placed on the surface 23 and indicate the location of a switch which will play the note indicated thereon. In FIG. 6 the indicator 37′ has a number appearing thereon indicated as 39. The number 39 indicates the step in the sequence that that particular switch should be depressed. Therefore, by positioning a multiplicity of indicators 37′, each bearing a number in sequence on the covering 23 by the particular switch to be depressed, an individual's movement across the platform may be specifically defined, and the sound generated will be coordinated with that movement.

While the device described above is illustrated as a floor or platform placed on the floor, it is to be understood that the device described can be used in any surface and such surface does not have to be planar. In addition, while it was intimated in the discussion hereinabove that the pressure-sensitive switching devices are depressed by an individual's foot, this is by no means a limitation on the use and operation of the device and the pressure-sensitive switching devices may be depressed by any means capable of depressing the pressure-sensitive switching devices and any manner compatable with the configuration of the surface in which the pressure-sensitive switching devices are used.

Figure 7:
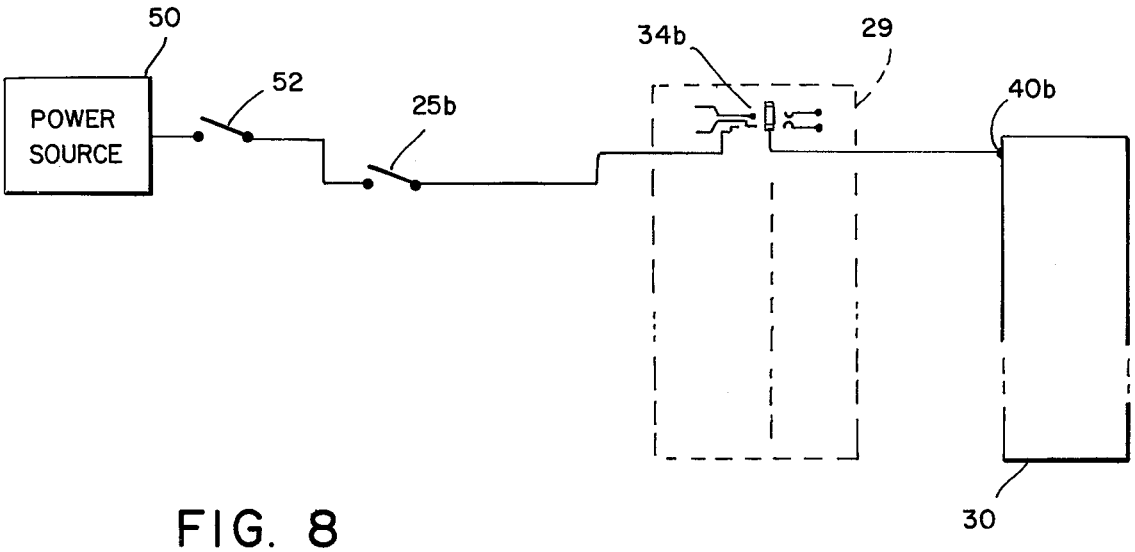
FIG. 7 is a circuit diagram of the device constructed in accordance with the present invention.

There is illustrated in FIG. 7 a circuit for the device hereinabove described. A current source 50 is provided which will energize the sound generating apparatus 30. A master control switch 52 which may be positioned on the support surface 24 controls the operation of the device. If any of the switches 25 are closed before the master control switch 52 is closed, no signal is produced. Therefore, until the master control switch 52 is closed, an individual may move over the surface 23 without causing a signal to be generated. Each of the switches 25 is in circuit with the master control switch 52 and the current source 50. As mentioned hereinabove, a select number of the switches 25 are connected to terminals 34 on the programmer 29 which are connected to the input contacts 40 in the sound generating apparatus 30. For example, switch 25*b* is in circuit with terminal 34*b* and input contact 40*b*. Similarly, switches 25*c*, *d*, and *e* are connected in circuit with input contacts 40*c*, *d*, and *e* through terminals 34*c*, *d*, and 3. Some or all of the switches 25 may be placed in circuit with input contacts on the sound generating apparatus.

When the master control switch 52 is closed, thereafter as each one of the selected switches 25 is closed, an electrical current will flow from the power source to a particular contact on the sound generating apparatus 30 activating same to produce a signal.

In the device thus for described, the signal produced when a particular switch 25*a* is closed can be varied by physically disconnecting the conductor leading from the switch 25 to the terminal in the programmer 29 and connecting it to another terminal on the programmer which corresponds to a different signal. In this manner, the signal produced when each switch 25 is closed may be changed.

Figure 8:
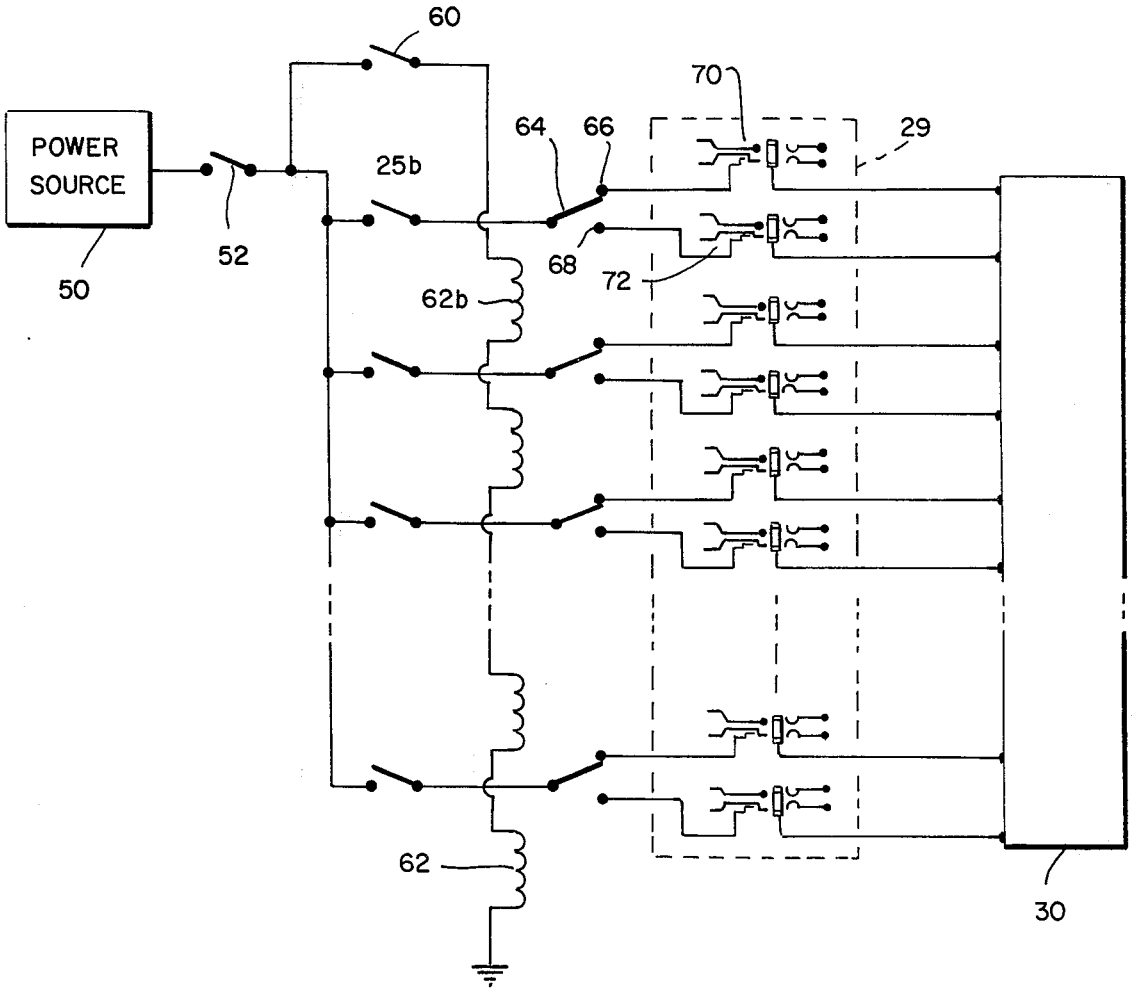
FIG. 8 is a circuit diagram showing the electrical switching means.

In an alternative embodiment electrical switching means are provided which will automatically change the signal which will be produced when a switch or series of switches are closed. This electrical switching means is illustrated in FIG. 8. A switch 60 which may be positioned on the support surface 24, is in circuit with the power source 50 and a series of relays 62. The switch 60 is of the type which when depressed will stay closed until it is again depressed. To return to its open position it can be positioned on the support surface 24 so that an individual can vary the signals to be provided while remaining on the device. It is to be appreciated that while the electrical switching means described herein includes relays, other types of switching means such as transistors may be employed. When the switch 60 is closed, the relays 62 will be energized resulting in the contacts in the relays moving from one posisiton to another, bringing each switch 25 into circuit with a different terminal which is connected to a different input contact on generator 30. As illustrated in FIG. 8, switch 25*b* has a relay 62*b* associated therewith having a contact arm 64 therein which contacts relay terminal 66, when the relay 62*b* is not energized. Relay terminal 66 is connected to terminal 70 on programmer 29, which, for means of illustration, is connected to the input contact 40*b* on the sound generating apparatus so that when the switch 25*b* is closed, a sound, which for means of illustration may be a C sharp note is produced.

When switch 60 is closed, the relay 62*b* is energized causing contact arm 64 to engage relay terminal 68 (as illustrated in phantom lines). Relay terminal 68 is connected to terminal 72 on the programmer 29 which is connected to a different input contact 40 to produce, for example, a B flat note when switch 25*b* is closed. When switch 60 is open, the contact arm again engages relay terminal 66. While only one relay has been described to vary the signal which will be produced when one switch is closed, it will be appreciated that the signal to be produced when any number of all of the multiplicity of switches located in the support surface are closed may be varied likewise. Similarly, when a particular relay is energized, it may result in its associated switch producing no signal when it is closed.

Further, more variation in the signals to be produced may be caused by adding additional relays in association with each of the switches 25 to increase the number of terminals on the programmer 29 with shich the switch 25 can be brought into circuit with.

In another embodiment, the switch 60 is replaced by a time switch which serves the same function, i.e., energizing the relays. However, instead of being opened or closed by the individual on the device, it is opened or closed after a certain period of time passes so that the signals produced by each switch will be automatically changed upon after a set period of time. Switches of this type are well known in the art and will not be described herein.

It can be seen from the foregoing detailed description that the object of the present invention; namely, to create a device for producing a signal in response to a movement thereon wherein the signals to be produced can be easily and rapidly changed has been achieved by providing a multiplicity of pressure-sensitive switching devices mounted beneath the surface, a selected number of which are connected by circuit means through a programmer to at least one signal generating apparatus. When a pressure-sensitive switching device is closed, the signal generating apparatus is activated and a particular signal is produced. As a series of pressure-sensitive switching devices are closed as an individual moves across the surface the signals produced will be coordinated with that movement.

The presence of the programmer permits any pressure-sensitive switching device to be placed in circuit to generate any identified signal so that each pressure-sensitive switching device can be made to activate a particular signal. The programmer permits the signal generated when a particular pressure-sensitive switching device is closed to be changed.

In an alternative embodiment, electronic switching means in the circuit will automatically place the pressure-sensitive switching devices in a different circuit to vary the signal produced when one or all of the pressure-sensitive switching devices are closed. The electrical switching means may be responsive to movement on the surface of the switching device or may vary the signal to be produced after a predetermined time period.

While in accordance with the patent statutes a preferred embodiment has been shown in detail, it should be particularly understood that the invention is not limited thereto or thereby.

What is claimed is:

1. A device for producing a musical signal in response to a movement thereon comprising:

a. a support surface;

b. a cover surface disposed upon said support surface;

c. a current source;

d. a multiplicity of pressure-sensitive switching devices mounted in a predetermined pattern in said support surface in circuit with said current source;

e. at least one musical signal generating means adapted to produce a musical signal, said musical signal generating means having a series of input contacts which when current is delivered to an input contact, will cause an identified musical signal to be produced; and f. a programmer in circuit with said pressure-sensitive switching devices and said at least one musical signal generating means permitting one or all of said pressure-sensitive switching devices to be placed in circuit with a particular input contact on said at least one musical signal generating means, said programmer being provided with terminals identified as to the characteristics of the musical signal to be produced when said pressure-sensitive switching devices are connected thereto and said pressure-sensitive switching devices are closed; further comprising:

g. electrical switching means adapted to change the musical signal which will be produced when a particular pressure-sensitive switching device is closed; said electrical switching means including a switch positioned in circuit with said current source and at least one relay in circuit with said switch, said relay placing at least one of said pressure-sensitive switching devices in circuit with one input contact on said sound generating means when said switch is open and placing said pressure-sensitive switching device in circuit with another input contact on said signal generating means when said switch is closed.

2. The device in accordance with claim 1 wherein said switch is a pressure-sensitive switch positioned on said support surface.

3. The device in accordance with claim 1 wherein said switch is a time action switch which will close after a predetermined period of time has elapsed.

* * * * *